US005277426A

United States Patent [19]

Gerpheide et al.

[11] Patent Number: 5,277,426

[45] Date of Patent: Jan. 11, 1994

[54] SPORTS SIMULATION SYSTEM

[75] Inventors: George E. Gerpheide, Salt Lake City, Utah; Donald A. Wilson, 7638 Mary Esther Cir., Salt Lake City, Utah 84093; Jack S. Kelliher, Sandy, Utah

[73] Assignee: Donald A. Wilson, Salt Lake City, Utah

[21] Appl. No.: 797,421

[22] Filed: Nov. 22, 1991

[51] Int. Cl.[5] ..... A63B 69/36

[52] U.S. Cl. ..... 273/185 B; 273/185 R; 273/358

[58] Field of Search ..... 273/185 R, 185 A, 185 B, 186 R, 186 C, 183 R, 26 R, 358, 439

[56] References Cited

U.S. PATENT DOCUMENTS

| | | | |
|---|---|---|---|
| 4,150,825 | 4/1979 | Wilson et al. . | |
| 4,429,880 | 2/1984 | Chen et al. . | |
| 4,437,672 | 3/1984 | Armantrout et al. . | |
| 4,572,509 | 2/1986 | Sitrick | 273/439 |
| 4,636,951 | 1/1987 | Harlick | 273/439 |
| 4,702,475 | 10/1987 | Elstein et al. | 273/29 A |
| 4,751,642 | 6/1988 | Silva et al. | 273/185 B |
| 4,915,384 | 4/1990 | Bear | 273/26 R |
| 4,958,835 | 9/1990 | Tashiro et al. | 273/439 |
| 5,056,791 | 10/1991 | Poillon et al. | 273/185 B |
| 5,074,558 | 12/1991 | Bleich et al. | 273/121 A |
| 5,101,354 | 3/1992 | Mowers et al. | 273/54 C |
| 5,123,647 | 6/1992 | Lawlor et al. | 273/121 A |

*Primary Examiner*—Jessica J. Harrison

*Attorney, Agent, or Firm*—Mallinckrodt & Mallinckrodt

[57] ABSTRACT

Sport simulation equipment, such as a equipment for simulating a game of golf, and made up of a plurality of components, each component adapted to carry out a function of the system in coordination with other components, and a control circuit for directing and coordinating operation of the system components, incorporates a communication system whereby each component may be connected to a transmission line and can send and receive information regarding coordination and operation of components. Each component includes a communication interface circuit which is connected between the component and the transmission line to send and receive information via the transmission line. The control circuit include a similar communication interface means connected to the transmission line. In a preferred embodiment of the invention, communication is initiated by a request in a predefined format addressed to a component to which the component responds in a predefined format. A preferred predefined format consists of one or more fields of eleven bits each which each include eight data bits.

16 Claims, 6 Drawing Sheets

SPORTS SIMULATION SYSTEM

BACKGROUND OF THE INVENTION

1. Field

The invention is in the field of apparatus for simulating the playing of sport games, particularly the simulating of playing a game of golf.

2. State of the Art

Various arrangements are used for simulating the playing of a game of golf in small areas, such as indoors, to provide opportunities for people to play who might not otherwise be able to play because of crowded golf course conditions or because of bad weather. In addition, such golf simulators can simulate play on various famous golf courses not otherwise accessible to the players.

Most golf simulation equipment includes at least three components: a central control unit which keeps track of play and calculates ball travel and lie, a sensor unit which senses how a ball is hit to enable the control unit to calculate the trajectory and resulting lie of the hit ball, and a projection unit for projecting an image showing the green to which the ball is to be hit from the location of the ball. Because the equipment senses how a ball is hit and the distance and direction of travel of the ball, such equipment could also be adapted to simulate various other sport games, such as baseball or soccer, or at least various practice aspects thereof.

U.S. Pat. Nos. 4,150,825 and 4,437,672 show a type of golf simulation game. In the game of the patents, one to four players initially enter information into the control unit regarding the players and the mens, women, or championship tees from which each will play, and the particular course and holes to be played , e.g., the front nine, back nine, etc. The control unit then operates a display to show who is to tee off and operates a projector to project an image on a screen in front of the players showing the view toward the green from the tee. The player hits his ball from the tee toward the green as he or she would on a regular golf course, the ball flying toward and hitting the screen which is specially design for that purpose and is usually located about twenty feet in front of the player. Special sensors in the form of photosensor arrays are arranged to detect passage of the ball through three separate sensing planes, the third plane being positioned with respect to the screen so as to sense the ball's movement toward the screen and also the ball's rebound from the screen. With the information from the sensors, the ball's trajectory ca be calculated and the position at which the ball lands along the fairway can be determined relatively accurately. The control unit keeps track of each player's ball and the position at which it landed. After all players have teed off, the control unit determines which player's ball is farthest from the hole and causes operation of the projector to move to and project an image on the screen showing the view from the position of the farthest ball looking toward the green. The player again hits his or her ball toward the green shown on the screen and again the trajectory of the ball is calculated and the new position along the fairway determined. The control unit then again determines the farthest ball from the hole, displays the name of the player, and instructs the projector to provide the new appropriate image. The identified player then hits his or her ball. Play is continued in this manner until all players reach the green. At that time, a simulated green is lighted and the players actually putt the ball into a hole in the simulated green.

In some embodiments of the equipment shown in the referenced patents, a light spot projector is included to project a light spot on the screen representing the flight of the golf ball down the fairway as it is hit. Various other accessories may also be added to the equipment.

With the equipment shown in the referenced patents and similar equipment known to the inventor, the equipment is designed as a whole with the various sensors, projectors, etc. all designed to be operated and integrated through specifically designed control circuitry with the required interconnections being made by individual wires extending between the control circuitry and the various components. The problem with such construction is that it is difficult to make improvements in various parts of the equipment. For example, if an improvement is made to the projector unit, such as the improvement shown in cited U.S. Pat. No. 4,437,672, the control unit also has to be physically changed in order to effect control of the improved projector and additional wiring between the control unit and projector has to be installed. This slows the implementation of improvements to the equipment because with an improved projector unit, not only is the projector unit replaced, but also the control unit and wiring in between. Thus, rather than improved components of the equipment being added as they are improved, major improvements in the total equipment must be made to encourage users to purchase and install totally new equipment.

SUMMARY OF THE INVENTION

According to the invention, sports simulation equipment may have component parts thereof easily added, replaced, or upgraded without having to replace or modify other components and the wiring between components by constructing each of the components as self contained units having a standardized communication capability so that each unit can be connected to a common communication line to allow communication between all units. No additional wiring or rewiring is required to connect additional or replacement units to the equipment, other than connecting the units to existing communication lines. The control unit is preferably microprocessor based, as in the prior art, but with the standardized communication system. When additional components are added or components are upgraded, the most that needs to be done to the control unit is to reprogram its microprocessor.

In a preferred embodiment of the system, the control circuitry includes a microprocessor programmed to control and coordinate operation of the entire system. The control circuitry also includes a communications or network interface to connect to the communication line. The control circuitry is programmed to send control communications to the various system components and to receive and evaluate communications from the various components. Each component includes its own operating circuitry, which may include a microprocessor, to control operation of the component and produce signals representative of the operation or status of the component, and a communications or network interface to connect the component to the communication line. With the control circuitry and individual components all connected to the communication line, two way communication can be had between the control circuitry and the components equipped for two way communication. In some cases, certain components may only need the capability of one way communication from the control circuitry to the component to receive signals directing operation of the component. In most cases, however, feedback to the control circuitry from the component is desirable so provision for two way communication is usually provided. Also, if desirable, communication between components can also be provided for.

In a preferred embodiment of the invention, communication between the control circuitry and the components is through a communication protocol using one or more fields of eleven bits each for each message to be communicated. Each field begins with a start bit followed by eight bits (one byte) of information, followed by a flag bit and a stop bit. Some messages may merely be a single field in length, such as some acknowledgement messages, while other messages will require a number of fields. In such case, the initial field will usually be an address field, i.e., the information in the field will be the address of the component to which the message is directed, and the second field will indicate the length of the message to follow, i.e., how many fields make up the message. The third and predetermined number of succeeding fields will contain the message, such as an instruction or question to a component, followed by the last field which provides a check sum by which the receiving component can determine if a valid message was received.

By using standardized communication between components, individual components may be easily changed or added to change or improve the overall simulation equipment. The only requirement is that the component be made to receive and send information via the particular protocol being used.

THE DRAWINGS

The best mode presently contemplated for carrying out the invention in actual practice is illustrated in the accompanying drawings, in which:

FIG. 1 is a block diagram showing several components of a sports simulation apparatus;

FIG. 2, a circuit diagram of two of the blocks of FIG. 1;

FIG. 3, a schematic showing of a communication between the control unit and a component;

FIG. 4, a schematic showing of a communication between a component and the control unit;

FIG. 5, a block diagram similar to that of FIG. 1, but showing the input means and display means as separate components;

FIG. 6, a block diagram of the sensing unit;

FIG. 7, a timing diagram showing operation of the sensing unit;

FIG. 8, a flow chart of an algorithm used in the sensing unit; and

FIG. 9, a flow chart of an additional algorithm used in the sensing unit.

DETAILED DESCRIPTION OF THE ILLUSTRATED EMBODIMENT

Figure 1:
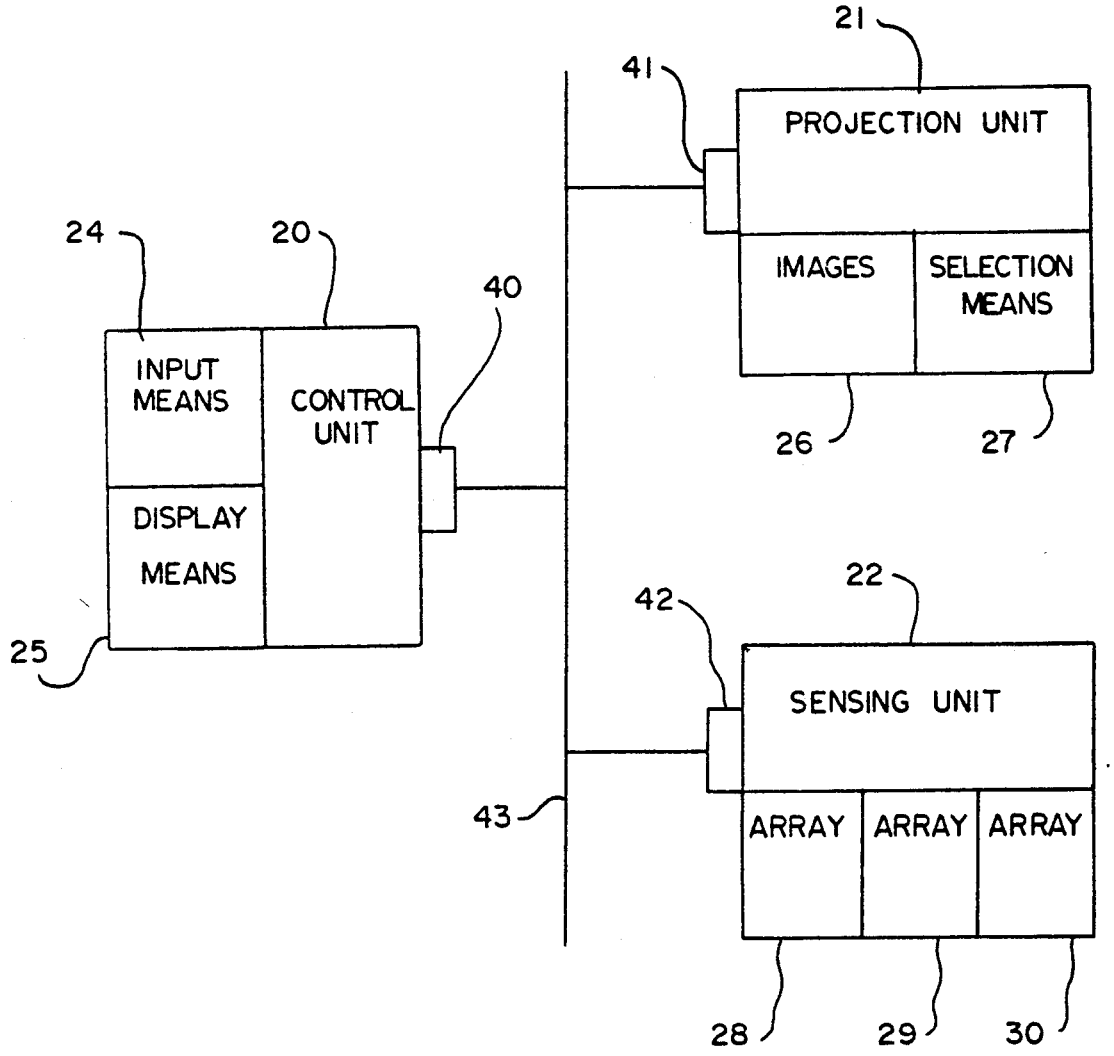

A golf game simulating apparatus as shown in either of U.S. Pat. Nos. 4,150,825 or 4,437,672, reference being directed to such patents for the physical arrangement and details of operation of the various components, broadly includes, as shown in FIG. 1 hereto, a control unit 20 which controls operation of the apparatus, a projection unit 21 which projects a selected one of a number of stored images onto a screen, not shown, and a sensing unit 22 which senses when a golf ball is hit by a golfer and certain parameters of travel of the golf ball from which the expected trajectory of the hit ball, if left free to travel as hit, can be calculated. For the embodiments of the apparatus shown in the referenced patents, the control unit includes player input means 24 in the form of push buttons or a keyboard so players can enter information and or players names, tees to be played, and golf courses to be played, into the apparatus and a display means, such as a light emitting diode (LED) display or liquid crystal (LCD) display, to enable the control unit to display instruction or information such as the name of the player who is to hit. The projection unit 21 includes a number of images 26 stored therein, such as on a roll of film, and selection means 27 for selecting one of the stored images to be projected. The sensing unit includes three infrared photo sensing arrays 28, 29, and 30, to sense movement of a golf ball through the field of view of each of the arrays. As shown by U.S. Pat. Nos. 4,150,825 and 4,437,672, the prior art apparatus of the patents interconnects the various components directly through direct wiring to the control unit. If changes are made to one of the components, most likely, wiring changes to various other components of the apparatus or associated changes in other components of the apparatus are also necessary.

As shown in FIG. 1, according to the present invention, each of the components also includes an interface means. Thus, control unit 20 includes interface means 40, projection unit 21 includes interface means 41, and sensing unit 22 includes interface means 42. Each of the interface means is connected to a transmission line 43. There are two types of interface means, a master interface represented by interface 40 of the control unit which initiates each exchange of information between components, and slave interface means represented by interfaces 41 and 42 which respond when communication is directed to them from the master. Each system will have one master interface means, and as many slave interface means as needed for the various components of the system.

Figure 2:
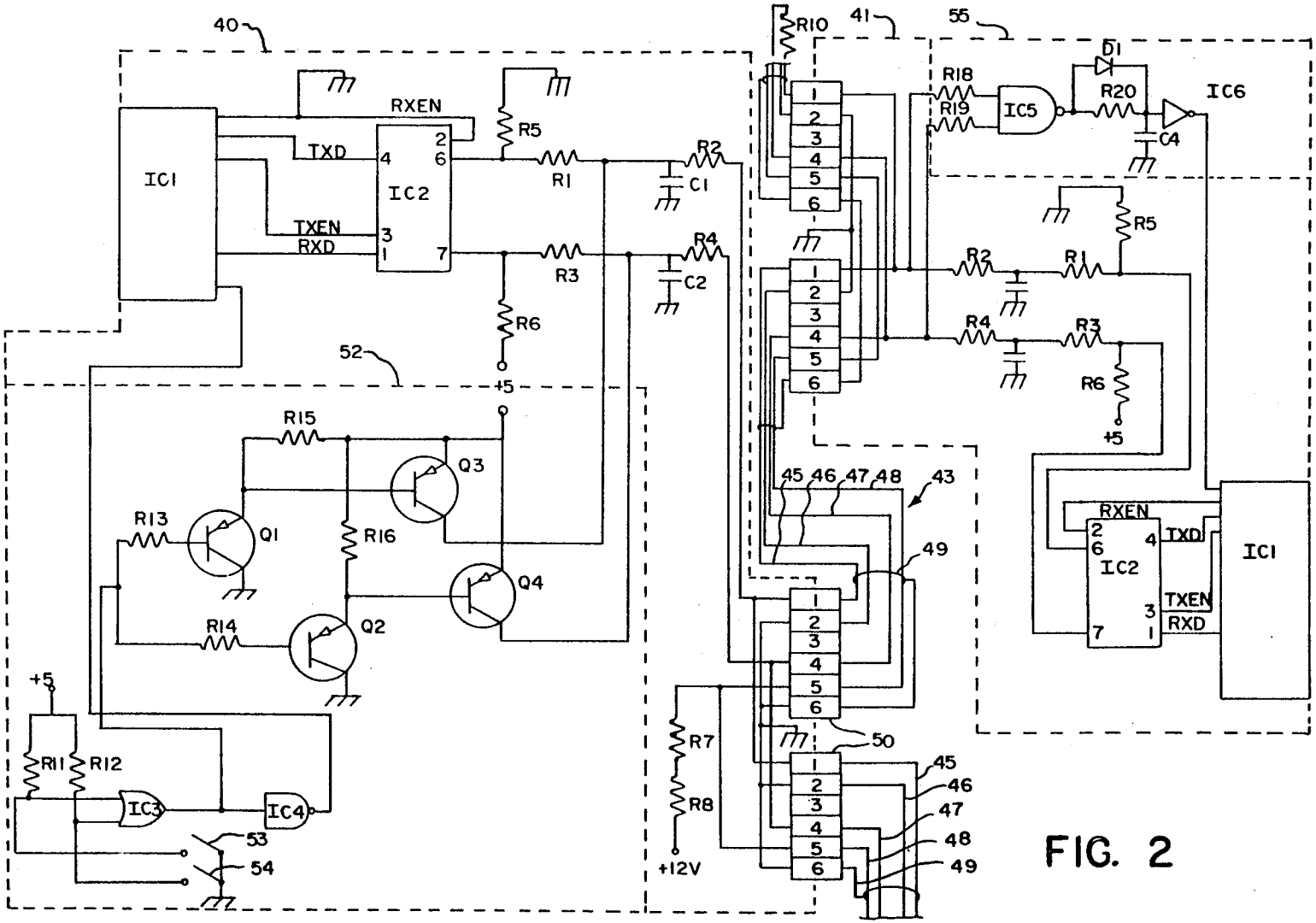

Transmission line 43 includes four conductors 45, 46, 47, and 48, FIG. 2, and is shielded as shown by connection 49. The components are connected to the transmission line 43 through connectors such as standard six conductor RJ-11 connectors 50. Each component has two connectors 50 connected in parallel so that transmission cables 43 can be connected between components in "daisy-chain" fashion. The connections through connectors 50 of FIG. 2 of each component are equivalent to the connection shown schematically in FIG. 1 of each component to transmission line 43. In the preferred embodiment illustrated, conductor 45, shown connected to connector position 1, is the positive communication line; conductor 46, shown connected to connector position 2, is a ground line; conductor 47, shown connected to connector position 4, is the negative communication line; and conductor 48, shown connected to connector position 5, is a positive supply voltage of twelve volts. The transmission line shield 49 is connected to connector position 6.

The interface means are generally the same, but with one such means having a system reset driver and the remaining interface means each having system reset receivers. The actual communication portions of the circuits are the same for each interface means. While the reset driver circuitry may be provided in any of the components in association with either a master or slave interface means, it is illustrated in FIG. 2 as part of the master interface means 40 and a reset receiver is shown as part of the slave interface means 41. The reset driver will generally be associated with the component including the player input means and is operated, usually by operating a reset switch, to reset the entire apparatus or system, for example, at the beginning of a new game. If the player input means is a separate component of the system with its own slave interface means, the system reset will generally be part of that particular slave interface means, and all other interface means, including the master interface means, will include reset receivers.

Each of the interface means communicates with other interface means through a serial transmission of information from one interface means to selected other interface means. In a preferred embodiment, such communication is through NRZ serial transmission of eleven bit characters at a baud rate of 19.2 Kbaud. Each bit represents either a "Zero" or a "One" and is indicated through the transmission line as voltages on the communication positive line 45 and the communication negative line 47. The "Zero" state is indicated by the voltage on the negative line 47 being more than 500 mv more positive than the voltage on the positive line 45. Conversely, the "One" state is indicated by the voltage on the positive line 45 being more than 500 mv more positive than the voltage on the negative line 47. Voltage on either line must be between zero and five volts.

Communication is controlled by a microprocessor programmed to transmit and receive information. A separate microprocessor IC1, FIG. 2, such as an Intel 8031 with accompanying memory and support chips, not shown, may be used primarily for transmission and reception of communications, or a microprocessor used to control operation of a component itself may also function as the microprocessor IC1 to control communication. Where a separate microprocessor IC1 is used, it will be connected to the control circuitry for the component, such component control circuitry itself usually including a microprocessor, in any of a variety of well known ways.

The microprocessor IC1 includes an internal universal asychronous receiver transmitter (UART) which is capable of transmitting or receiving eleven bit fields of serial data. The microprocessor UART is connected to an RS-485 transceiver chip IC2, such as a Texas Instruments SN75176, which provides the differential driving voltage for the positive and negative lines or receives the differential voltage as present on the positive and negative lines. Serial data is transmitted from the UART of IC1 to IC2 on the line labeled TXD and serial data is received by the UART of IC1 from IC2 on the line labeled RXD. The baud rate is set internally by microprocessor IC1. The positive line terminal of IC2 is connected to the positive line 45 (connector position 1) through resistors R1 and R2 with capacitor C1 connected to ground therebetween. This forms a filter to minimize radiation of electrical noise from the unit and to provide protection from electrostatic discharge. The negative line terminal of IC2 is similarly connected to the negative line 47 (connector position 4) through resistors R3 and R4 with capacitor C2 connected to ground therebetween. Resistor R5 is connected between the positive line terminal of IC2 and ground as a pull-down resistor and resistor R6 is connected between the negative line terminal of IC2 and a positive five volt source as a pull-up resistor.

The receiver and transmitter of IC2 are each individually enabled. The enable line of the receiver labeled RXEN is connected to ground, either externally or internally through IC1, so that it is always enabled and ready to receive information. The enable of the transmitter is connected to the TXEN line from IC1. This allows the microprocessor of IC1 to enable IC2, when desired, to transmit information.

The voltage supply line 48 is connected through current limiting resistors R7 and R8 to a positive twelve volt supply in the master interface means 40. In this way, if power is needed by a component connected to the line at a remote location, power can be obtained from this voltage supply line. In most cases, however, particularly where power requirements are relatively great, such as for operation of the projection unit 21, a separate power supply will be provided in unit 21 so no power connection will be made to line 48. Ground line 46 is grounded in each interface unit. The transmission line shield 49 is grounded at the master interface unit 40, but not at the other interface units.

Where no connection is made through a connector of a component to a transmission line, i.e., the component is the last component on the line, a passive termination resistor is connected to the connector between the communication positive and negative lines. Thus, as shown in FIG. 2, resistor R10 is connected between communication positive line 45 and communication negative line 47 where it is connected to top connector 50 of communication means 41. The resistor will be of a value to match the characteristic impedance of the shielded cable used, and usually will be between 50 and 100 ohms.

The master interface means 40 includes system reset driver circuitry 52. Since this circuitry resets all components of the system or apparatus, its operation is protected by two reset switches, usually a reset switch 53, and a key operated reset switch 54. The switches 53 and 54 are connected between the inputs to "or" gate IC3 and ground. With the reset switches open, as shown, the inputs to IC3 are connected through resistors R11 and R12, respectively, to the five volt source so both inputs to IC3 are high. This produces a high output of IC3 which is connected through resistor R13 to the base of transistor Q1 and through resistor R14 to the base of transistor Q2. This high signal on the bases of transistors Q1 and Q2 turn the transistors "off" and a five volt high signal is applied from the five volt supply through resistor R15 to the base of transistor Q3 and through resistor R16 to the base of transistor Q4. This keeps transistors Q3 and Q4 in "off" condition so no voltage appears on the collectors of the respective transistors. This condition remains if either reset switch 53 or 54 is closed since one input to IC3 remains high so its output remains high. If both reset switches 53 and 54 are closed, both inputs to IC3 are grounded, or low, and the output of IC3 goes low. This causes a low on the bases of transistors Q1 and Q2 to turn them "on" to provide low signals to the bases of transistors Q3 and Q4 to turn them "on". This causes substantially five volts to appear on the collectors of transistors Q3 and Q4 and this five volts is applied through transistor Q3 to the positive communication line 45 and through transistor Q4 to the negative communication line 47. Thus, for the system reset condition, both the positive and negative communication lines are high. The output of IC3 is also connected to invertor IC4 which is connected to microprocessor IC1 so that when the output of IC3 goes low to indicate a reset condition, the output of IC4 goes high to indicate a reset condition to microprocessor IC1.

A reset receiver 55 is shown in slave interface means 41. The positive communication line 45 (connector position 1) is connected through resistor R18 to an input of NAND gate IC5 and the negative communication line 47 (connector position 4) is connected through resistor R19 to a second input of NAND gate IC5. IC5 produces a high output except when both inputs are high. Thus, when both inputs are high, indicating a reset condition, the output of IC5 goes low. In all other cases the output of IC5 is high. The high output of IC5 passes through forward biased diode D1 to the input of invertor IC6, and the high voltage builds up on capacitor C4. When the output of IC5 goes low to indicate a reset condition, capacitor C4 will discharge through resistor R20 (diode D1 is now reverse biased). When capacitor C4 discharges sufficiently to present a low signal to the input of invertor IC6, IC6 provides a high output which is connected to microprocessor IC1 to indicate a reset condition. This provides a slight delay, the time of the delay being determined by the time constant of the RC circuit formed by R20 and C4, so that the two high signals must be received by IC5 for a set length of time before a reset signal is generated by IC6. This prevents accidental reset of the circuitry.

In operation of the system, all communication between system components originates with the control unit through the master interface means 40. Each component has a preassigned address. The master directs a "request" to a particular slave interface unit which is identified by address. All slave interface means receive the request and their associated components each determine if the request is addressed to it. The component to which the request is addressed then receives and executes the request, i.e., performs the requested action, and sends a "response" back to the master. The master will not send another request until it receives a response to a request or until a certain period of time passes and no response is received. In the latter case, if a response is not received within the certain period of time called the "time-out period", the master resends the unanswered request addressed to the same component If a certain preset number of retries are unsuccessful, the master will generally provide an error message asking that the nonresponding component be checked. Together, the request, any retries of the request, and the associated response are all considered as a system "command".

While the commands, i.e., the requests and associated responses, may use various protocols, the presently preferred protocol for the system requires that the requests and responses take the form of one or more fields of eleven bits each. Each bit in binary terminology represents either a "one" or a "zero". As previously indicated, the "one" is physically indicated by the circuitry by driving the voltage on the positive communication line 45 more than 500 mv more positive than the voltage on the negative communication line 47. The "zero" is physically indicated by the circuitry by driving the voltage on the negative communication line 47 more than 500 mv more positive than the voltage on the positive communication line. The communication interface means each serially create these "one" and "zero" states on the lines during the transmission of a request or response while they each monitor and read the lines for these conditions at all other times.

Figure 3:
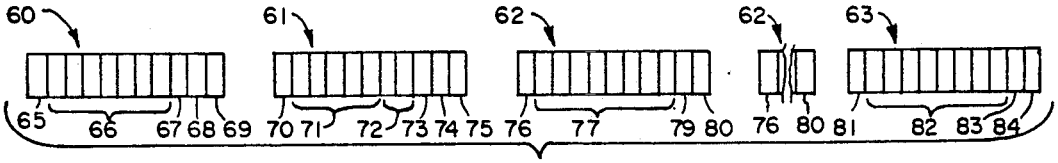

FIG. 3 illustrates schematically a request with several fields. Each of the fields begins with a start bit followed by eight bits (one byte) of information, followed by a flag bit and a stop bit. Each request begins with an address field 60 which addresses the request to a particular component. This is followed by a control field 61 which tells the component how many additional fields are in the request, and also provides information so the component can tell if it is properly sequenced with the request. The control field may be followed by up to thirty-one data fields 62. The last field 63 of the request is a check sum field. This provides a number in the data portion or information byte of the field which, when added to the other information bytes of the request, provides a preset number. In this way, the receiving component can tell if the request as received is correct. If the sum of all information bytes of the request add to the correct number, the request is assumed to be correct. If they do not add to the correct member, something is wrong with the request.

The address field 60 begins with a start bit 65 of "zero". This is followed by seven bits 66 representing the address of the component to which the request is directed. The address is a preassigned number identifying the particular component of the system to which the request is directed. Any available block of numbers could be set aside for use as addresses with a particular number assigned to each component. In a prototype system, numbers from 0 to 111, written in base sixteen where $0_x$ indicates base sixteen notation as $0_x00$ to $0_x6F$, are set aside for addresses. The eighth bit 67 is set to give the information byte odd parity, i.e., to make the number of ones in the byte odd. The flag bit 68 is set to "one" to indicate that the field is an address field. A "zero" flag bit indicates the field is other than an address field. The stop bit 69 is always set to "one" indicating to the hardware that it is the end of the field.

The control field 61 begins with a "zero" start bit 70 indicating the field is a continuation of the request. The next five bits 71, indicate the number of fields 62, called data fields, which follow. These five bits can indicate a number of following data fields between zero and thirty one. The next two bits 72 are sequencing bits and can also provide a communications reset command to the component. Two "zero" bits indicate that the component should reset its communication related functions, a "one" and a "zero" indicate an even sequence, and a "one" and a "one" indicate an odd sequence. The "zero" and "one" combination presently has no meaning and is available for future use, if necessary. These bits are followed by parity bit 73. The two sequencing bits 72, the five number bits 71, and the parity bit 73 make up the information byte of control field 61. A flag bit 74 and a stop bit 75 complete the control field 61. The flag bit is "zero" to indicate a field other than an address field.

It should be noted that if the sequencing bits are "zero" "zero", a reset request for communication functions of the addressed component is indicated. This generally will mean that the sequencing bits should be reset to even sequence and any information set to be transmitted should be cleared. The component will take such action in response to this request. If a reset is indicated, the bits 72 will be set to "zero" to indicate that no data fields follow.

The purpose of the sequencing bits are to ensure that the addressed component is in synchronization with the control unit. Upon start up of the system or a component, no successful communication can be had with the component until the component has been reset so that the control unit and component are synchronized i.e., the control unit knows the starting conditions of the component. After a reset command, both the control unit and the component begin with an even, "one" "zero" sequence. Each time a command is completed, i.e., the control unit sends a request to a component and the component sends an acceptable response that is successfully received by the control unit, the control unit increments its sequence for that component. Each time a component receives a request and completes a response back to the control unit, whether or not successfully received by the control unit since the component does not know whether the response has been successfully received, the component increments its sequence. Thus, with the component set so both the control unit and the component have an even sequence, the control unit will send a request to the component with a "one" "zero", or even sequence. Since the component also has a "one" "zero", or even sequence indicated, the component accepts the request, acts on it, and responds to the command unit. After the component sends its response, it increments itself to a "one " or odd sequence. If the control unit successfully receives the response, it also increments itself with respect to that particular component to a "one" "one" odd sequence. In such case, the next request sent to that component will have an odd sequence, which will match with the odd sequence of the component and the component will act on the request and respond. After the response, the component and control unit will both increment again to eve sequence for the next command.

If the master control unit does not receive a response from a component within a preset time period, or if it receives a garbled response, the master control unit will repeat the same request to the component. The retries are continued to a preset maximum number of retries. With a retry, if the component had not successfully received and acted upon the request previously sent, the sequencing of the retry is the same as the sequencing of the component so the component will accept, act on the request, and send a response. If the repeated request had been received and acted upon by the component and a response sent, but not successfully received by the control unit, the component would have incremented its sequence count upon sending the response, but the control unit would not have incremented its count since it did not successfully receive the response. In such case, the sequencing of the request and the component is not the same. The component assumes that the control unit did not successfully receive its response, and, rather than acting again on the request and getting out of synchronization with the control unit, merely resends its previous response. In this way, the control unit and the components remain synchronized in their operation and requests are not acted on multiple times.

The data fields 62 which follow the request control field 61 instruct the component as to the action it should take. Each data field 62 begins with a start bit 76 set to "zero" to indicate it is a continuing field. The next eight bits 77, the data bits making up the information byte, contain the actual data, i.e. number codes which have a particular meaning to particular components. Bit 79 is the flag bit set to "zero", and bit 80, the stop bit. The request may contain a single data field or up to a total of thirty-one data fields.

The data fields may contain universal instruction codes which are understood and can be acted upon by any of the components in a standard way, or may contain specialized instruction codes specific to each component. The universal instruction codes are usually embodied in a single data field 62 while the specialized instruction codes usually will require multiple data fields.

The universal instructions are particular preassigned numbers that are recognized by all components to have a particular meaning and require a particular response. These numbers are transmitted as the data bits of a data field 62. Again, any desired numbers could be used for the instruction codes. In the system prototype, the numbers 224 through 255, and 0, represented in base sixteen notation as $0_x$F0 through $O_x$FF and $O_x$OO, are reserved for universal instructions. As presently contemplated, four universal instructions are used. These are "Device Reset", represented by the code number $0_x$FD (253), which instructs a component to reset; "Device Version", represented by the code number $0_x$FE (254), which asks the component its version; "Net Version", represented by the code number $0_x$FF (255), which asks the component which version of the communication software or protocol is implemented in that component; and "Status", represented by the code number $0_x$00(0), which asks the component its current status. Various other universal instructions may be used as desired.

If specialized instructions are involved, as will be the case with most requests, such as requests instructing the projection unit to find and project a certain image or a question to the sensing unit as to whether it has sensed an object, the data bits will represent numbers recognizable by the component to which it is addressed. In the prototype unit, numbers between 1 and 223 ($0_x$01 and $0_x$DF) are set aside for specialized instructions.

The last field 63 of the request is the check sum field. Again, this field starts with a start bit 81. This is followed by eight bits 82 representing the check sum bits, a "zero" flag bit 83, and a stop bit 84. The check sum bits are set so that the sum of all of the information bytes in the request add up to a preset number. Any number between 0 and 255 may be chosen. In the prototype unit, the number 54 ($0_x$36) has been chosen. Thus, if the sum of all information bytes in the request add up to 54, the request was correctly received. If they add up to a number other than 54, the request was not correctly received.

Figure 4:
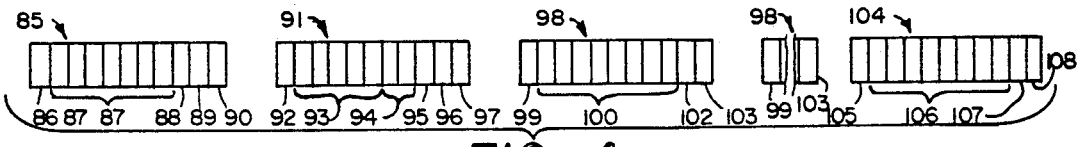

After a component receives a request, it will act on the request and send a response back to the control unit. A response is made up of one or more fields of eleven bits, similar to the request fields. FIG. 4 shows schematically a response of several fields. The first field 85 is a response type field. This includes a start bit 86, seven data bits 87 which contain a number chosen to represent the type of response, a parity bit 88, a flag bit 89, and a stop bit 90. Some standard responses may be a single field in length. If such is the case, no additional fields follow field 85. The response type field 85 is followed by control field 91 made up of start bit 92, five data bits 93 which indicate the number of data fields to follow, two unused bits 94 set to zero, parity bit 95, flag bit 96, and stop bit 97. This field is followed by the indicated number of data fields 98 which number between zero and thirty-one. Each data field begins with a start bit 99 and is followed by eight data bits 100. These are followed by a "zero" flag bit 102, and a stop bit 103. These are all similar to the format of the data bits described for the request.

The last field is the check sum field 104 made up of start bit 105, eight data bits 106, a flag bit 107, and a stop bit 108. As explained for the check sum field 63 of the request, the data bits provide a number which when added to all of the information bytes of the response, produce the number 53, or other selected number.

As indicated, each response begins with a response type field 85. The data 87 in this field is a number coded to indicate the type of response. Six such response types have been found satisfactory to cover situations encountered in the prototype unit. These are:

"Initialize Error", represented by the code number 113 ($0_x71$), meaning that the responding component has not been initialized for communication. This is a single field response and requires that the component be reset before it will accept requests.

"Busy", represented by the code number 120, ($0_x78$), a single field response meaning the device is busy and cannot execute a request at this time.

"Request Garbled", represented by the code number 114 ($0_x72$), a single field response meaning that the responding component did not properly receive the request.

"Request Error", represented by the code number 115 ($0_x74$), a single field response meaning that the responding component does not understand the request or cannot execute the request.

"Short Acknowledge", represented by the code number 112($0_x70$), a single field response meaning that the request was received and executed without error.

"Long Acknowledge", represented by the code number 115 ($0_x73$) meaning the request was received and executed without error and that a length field and data fields follow.

Upon start up of the system, or reset of the system, all components should reset and therefore be in initialized state ready to accept requests. However, to ensure this state of readiness, the master control will be programmed to poll each of the components to determine the status of each component. If a component responds with an "Initialize Error" response, the master control will send a reset request to reset the component. While various times may be allowed for response (the "time out period") before the request is resent, a time out period of 200 milliseconds has been found satisfactory. A minimum time that the component must wait between the end of a received request and the start of a response, or the time the control unit must wait between the end of a response and the start of a new request, has been set at 500 microseconds. This delay has been found necessary to allow the various circuits to change between transmit and receive modes so that the communications are accurately received.

Figure 5:
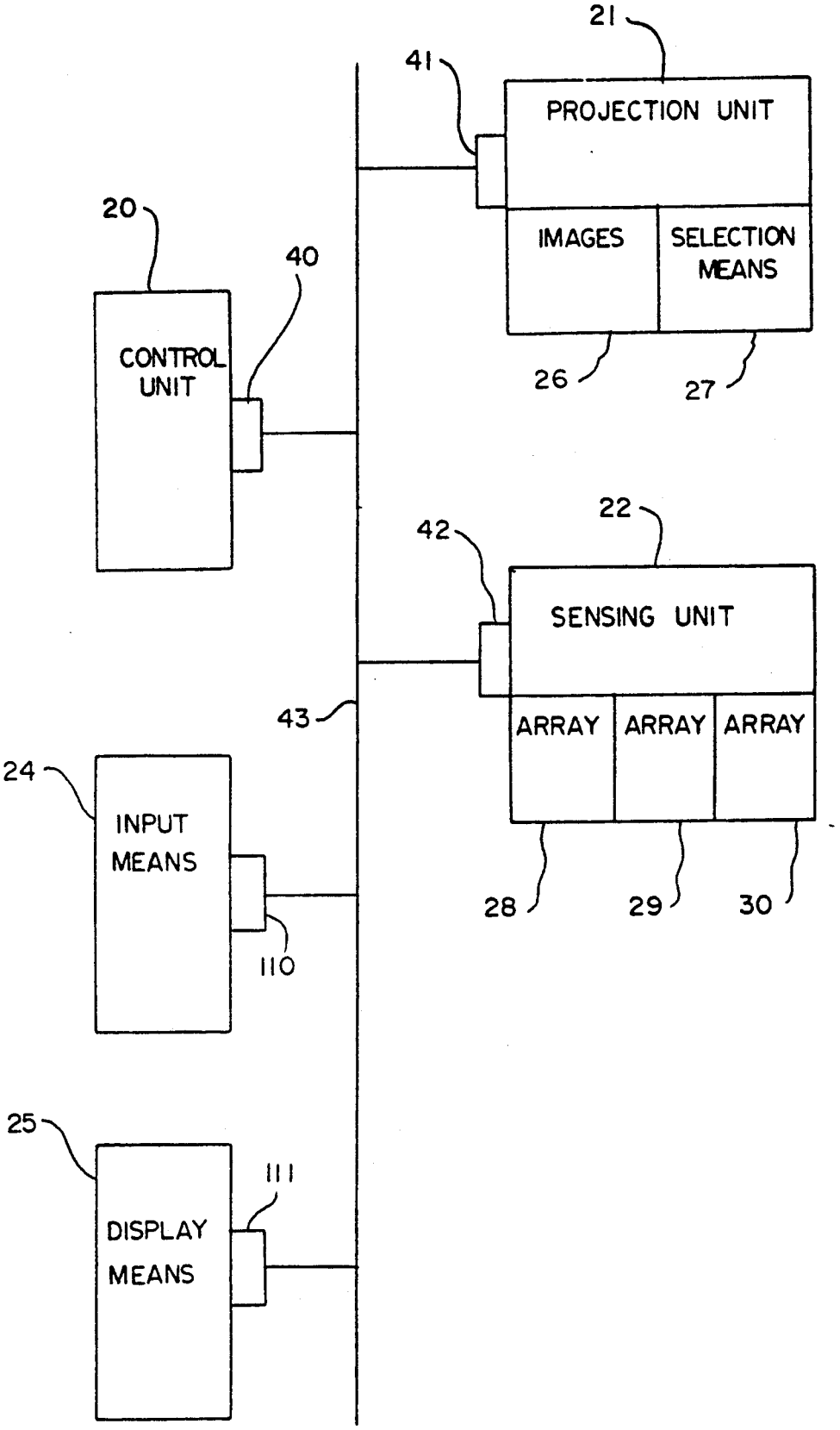

In the system shown by block diagram in FIG. 1 the control unit 20 is integrated with the display means 25 and input means 24. Such a unit may be constructed in accordance with the referenced patents, but with the addition of the communication interface means 40 as described herein connected to the microprocessor and the microprocessor programmed to communicate in the manner described herein. However, the control unit 20 may also be an independent unit as shown in FIG. 5. Referring to FIG. 5, the input means 24 may be a separate component and have its own communication interface means 110 connected to communication line 43. Similarly, display means 25 may be a separate component and have its own communication interface means 111 connected to communication line 43. Various of the other components could be broken down into further components, if desired.

The function of the central control unit is to coordinate and direct operation of the system. Thus, upon start up of the system, the central control unit will first poll all components to insure that they are reset (initialized) for communication purposes. It will then send requests addressed to the display unit prompting the user of the system to insert the necessary information through the input means, such as, the player names, the holes to be played, etc. For example, the control unit may send a request to the display means requesting the display means to display the words "ENTER NAME OF FIRST PLAYER". The display would then display such words and respond to the control unit that it has executed the request. The control unit will then send a request to the input means asking if any information has been inputed. If no information has yet been inputted, the input means would so respond. The control unit would continue to periodically poll the input means until information was inputted, at which time the input means would respond to the control unit that information had been inputted and would transmit the information to the control unit. The control unit may then send a request to the display means to display the next question needing input, such as "ENTER NAME OF SECOND PLAYER". This would continue until all information initially needed for play of the game was inputted and accepted by the control unit.

The projection unit 21 projects images on a screen in front of the player showing the scene looking toward the green that would appear from the place from which the ball is to be hit if the golfer were actually standing on the golf course. Initially, the image is that looking toward the green from the appropriate (i.e., men's, women's, or championship) tee. The images in a projection unit such as shown and described in the prior referenced patents are stored on a reel of film with approximately 900 still images. Thus, when the players have entered information regarding the holes to be played and the tees to be used, the control unit will determine which image is to be projected and send a request addressed to the projection unit instructing it to project a particularly identified image. In answer to the request, the projection unit would, under control of its own control circuitry such as its own microprocessor, cause operation of a means for moving the film and identifying the images projected, select and project the requested image. It would then send a response back to the control unit indicating that the correct image is being projected. A projection unit as described in the referenced patents could be provided with its own control and communication interface means to operate in the described system. An improved projection unit for use with a system of the present invention is disclosed in copending application Ser. No. 797,420, filed Nov. 22, 1991, and incorporated herein by reference.

The improved projection unit includes as a part thereof a ball image generator which projects a spot of light, representing the ball during flight after being hit. The control unit, using information obtained from the sensing unit, will supply information, through the request format, to the projection unit instructing the projection unit as to how to project such spot of light on the screen.

The shot sensing unit detects when a golf ball is hit toward the screen and senses parameters of the travel of the golf ball from which its trajectory toward the green can be calculated. The details of the parameter sensing and calculations are set forth in referenced U.S. Pat. No. 4,150,825. In the present system, as with the projection unit, the sensing unit has its own control circuitry, such as a microprocessor, which controls the unit in response to requests received over the communication line from the control unit 20 and provides responses to the control unit 20 indicating the results of operation of the sensing unit.

Figure 6:
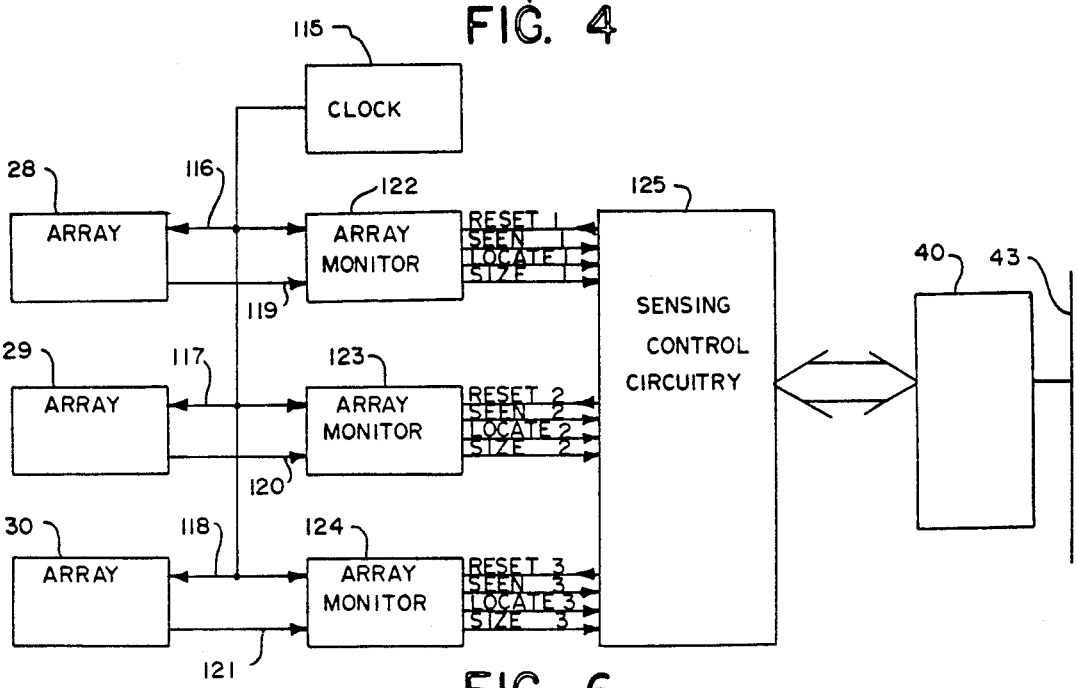

A more detailed block diagram of sensing unit 22 adapted for use with the invention is shown in FIG. 6. Each of the three arrays 28, 29, and 30 are electronic charge coupled devices (CCD) cameras as described in referenced U.S. Pat. No. 4,150,825 and operate as there described. Each camera includes a linear array of photosensitive CCD devices and periodically scans its field of view by scanning the array. Each array has a number of individual CCD devices, such as 512 individual CCD devices, arranged in a straight line. Each device is scanned for a period of one microsecond, with 512 individual devices, so the whole array is scanned in a period of 512 microseconds. Each scan is initiated by a start pulse produced by clock 115 and sent simultaneously to each of the arrays 28, 29, and 30 through respective start scan lines 116, 117, and 118. The start pulse lasts for one microsecond and occurs every 512 microseconds so that the arrays are continuously scanned. The output of each array is connected through output lines 119, 120, and 121 to respective array monitors 122, 123, and 124. The output of each of the arrays is low except when a bright object is detected by the array. The background at which the array is directed is dark enough so that no output is normally obtained from the arrays. When a golf ball moves through the field of view of one of the arrays, it is seen as a small, bright object. The particular devices in the array sensing the light from the object then produce a high output.

Figure 7:
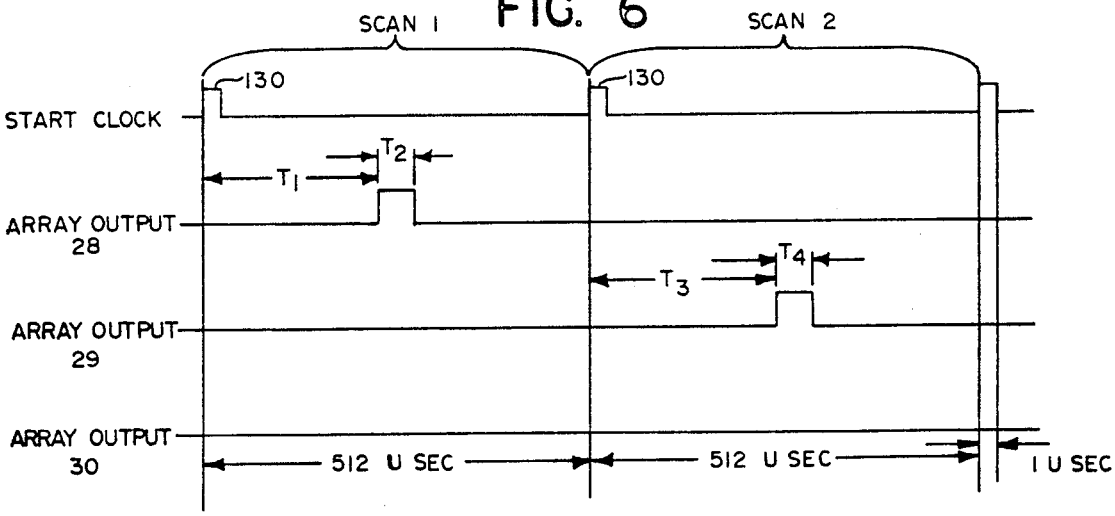

FIG. 7 is a timing diagram showing the output of the Start Clock on the upper line and the output of each of the arrays on the second line. As shown on the first line labeled "start clock", each start pulse 130, lasting for one microsecond and occurring every 512 microseconds, initiates a scan in each of the arrays. As long as an array merely senses the background, no output signal is produced. Thus, the fourth line, labeled "Array Output 30", has a continuous low signal through the two scans illustrated. When an array senses a bright object, it produces an output representation of the particular sensing devices in the array which have sensed the object. The line labeled "Array Output 28" shows an output signal between the first and second illustrated clock pulses 130 in the area labeled "Scan 1". This means that during the particular scan labeled as "Scan 1", array 28 detected a bright object during part of the scan. Actually, since each individual sensor in the array is scanned for one microsecond, keeping track of the times T1 and T2 provides information as to which sensors in the array sensed the bright object. Thus, the object was first detected at a time T1 after the scan started and was detected for a time T2. The line labeled "Array output 29" indicates that array 29 sensed a bright object during the period labeled "Scan 2". It was sensed a time T3 after the scan began and was sensed for the period T4.

The array monitors 122, 123, and 124 associated with each of the arrays 28, 29, and 30 respectively, receive the clock start pulse from clock 115 and start counting simultaneously with the start of a scan. The output of each array is connected to its respective monitor which detects the start of an output from its associated array and the end of the output from the array. Thus, during a scan when the array produces an output, the associated array monitor determines that a signal is present and produces an output on the "seen" output line to the sensing control circuitry 125. The array monitor also determines the location of the start of the signal, i.e., the location of the particular sensor that first detected the light, and produces an output indicative thereof on the "locate" output line. The monitor further determines the length of the output from the array, i.e., the number of sensors that sensed the light, and produces an output signal indicative thereof on the "size" output line. These determinations, i.e., the outputs on the "seen", "locate", and "size" lines, remain until the array monitor is reset by a signal on the reset line from the sensing control circuitry 125. For identification purposes, the various outputs of array monitor 122 representing the outputs of array 28 are labeled "Seen 1", "Locate 1", and "Size 1". The outputs from array monitor 123 representing the outputs of array 29 are labeled "Seen 2", "Locate 2", and "Size 2". The outputs from array monitor 124 representing the outputs of array 30 are labeled "Seen 3", "Locate 3", and "Size 3".

In most cases, an output signal from an array indicates a golf ball passing through the field of view of the array. However, it is possible that some other object may be detected. With a golf ball, the ball will pass through the field of view of array 28, then array 29, and then array 30. If the arrays progressively sense an object, it will be the hit golf ball that is sensed. The location and size information obtained from the arrays through the array monitors provide the information necessary to calculate ball trajectory. This information is communicated to the central control unit through sensing control circuitry 125 and communication interface circuitry 42.

The sensing control circuitry 125 preferably takes the form of a microprocessor such as an Intel 8031. The microprocessor is programmed to operate the sensing unit in accordance with the algorithms set forth in FIGS. 8 and 9.

Figure 8:
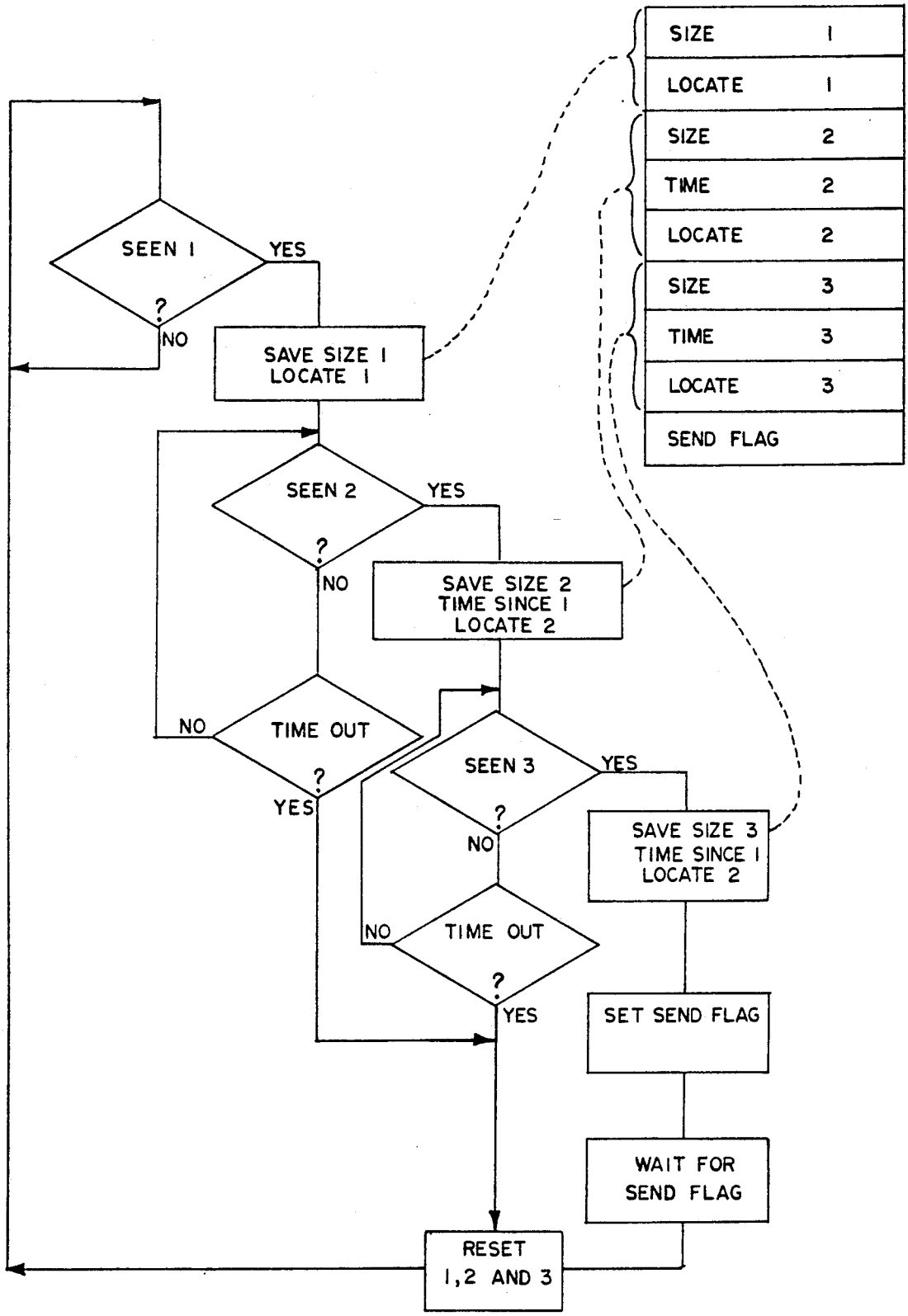

FIG. 8 illustrates the shot watching algorithm. This is a continuous loop which waits for a shot to be sensed by the arrays, starting first with the first array, i.e., array 28. The algorithm monitors the various output lines from the respective array monitors 122, 123, and 124.

After being reset, the program monitors the "Seen 1" line and waits for a signal indicating that a ball has been seen by array 28. When a signal appears on "Seen 1", the algorithm stores the "Locate 1" and "Size 1" parameters in a "shot data block" memory.

After waiting for a shot to be seen by array 28 and storing the data for that array, the algorithm waits for a predetermined time period for a shot to be seen by array 29, as represented by a signal on the "Seen 2" line from array monitor 123. If a shot is seen by array 29 within the "time out" period, the "Locate 2" and "Size 2" data is stored in the Shot Data Block memory, along with information generated by the algorithm representing the time elapsed between activation of "Seen 1" and "Seen 2". The algorithm then waits for a shot to be sensed, again with a preset "time out" period, by array 30, as represented by a "Seen 3" signal from array monitor 124. If a shot is seen by array 30 within the "time out" period, the "Locate 3" and "Size 3" data is stored in the Shot Data Block along with information generated by the algorithm representing the time elapsed between activation of "Seen 1" and "Seen 3", and a "send flag" is set. Operation of the algorithm is stopped until the send flag is cleared.

When the send flag is cleared, the algorithm proceeds to "Reset 1, 2 and 3" which resets arrays 28, 29, and 30 so there are no signals on the "Seen 1", "Seen 2", or "Seen 3" lines, and the algorithm starts again at the beginning watching for a shot to be seen.

If after receiving a signal on "Seen 1" but not seeing a signal on "Seen 2" within the "time out" period, the program proceeds to "Reset 1, 2 and 3" and then returns to the start of the program. If after receiving a signal on "Seen 2" but not receiving a signal on "Seen 3" within the "time out" period, the program again proceeds to "Reset 1, 2 and 3" and then returns to the start of the program.

Figure 9:
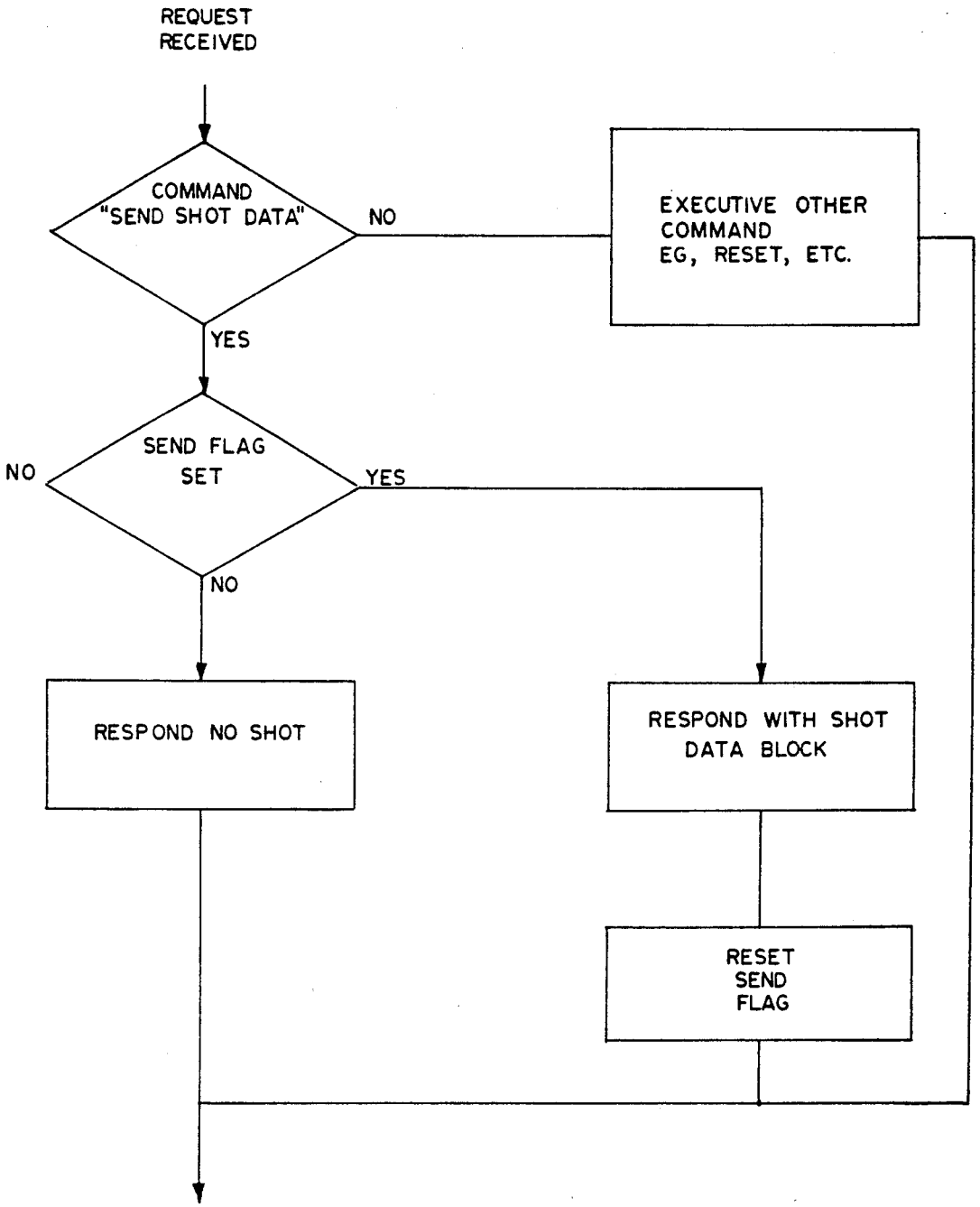

When the system is waiting for a shot to be sensed, the control unit will periodically send a request to the sensing unit asking if a shot has been sensed and to send the shot data. Upon receiving such a request from the control unit, the shot sending algorithm is activated. The shot sending algorithm is shown in FIG. 9. When a request is received addressed to the sensing unit, the algorithm determines if it is a request to send shot data. If it is, the algorithm checks to see if the "send flag" in the Shot Data Block is set. If the "send flag" is not set, the algorithm sends a "no shot" response to the control unit indicating that no shot has yet been sensed. The algorithm then waits until another request is received. If the "send flag" is set, all of the shot data in the Shot Data Block is transmitted as a response to the control unit. The "send flag" is then reset and the algorithm waits until another request is received. If a received request is not a "send shot data" request, the algorithm determines the other action to be taken and operates the sensing unit to carry out such other request, such as to reset the unit in response to a reset request.

The sensing control circuitry 125 is connected to the communication interface means 40 which is connected to transmission line 43 as previously described. Also as previously noted, the interface means 40 may be included as an integral part of a microprocessor forming the sensing control circuitry, but serving the purpose of the interface means 40 as described.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A sport simulation system, comprising a plurality of system components, each component adapted to carry out a different interrelated function of the system during play of the system and all components combining to provide the overall simulation of the sport, each having a communication interface means associated therewith; a control means for directing and coordinating operation of the system components during play of the system, said control means also having an associated communication interface means; a common transmission line interconnecting all interface means; means within said control means for generating component operation requests in a predefined format to direct operation of particular components and for directing component operation requests through associated communication interface means and the transmission line to the particular components and for receiving responses thereto from components means within each component to receive, through its associated communication interface means, requests from the control means, operate the component in accordance therewith, generate a response in a predefined format, and direct the response through its associated communication interface means and the transmission line to the control means.

2. A sport simulation system according to claim 1, wherein the predefined format requires that all requests and responses be made up of one or more fields of eleven binary bits each.

3. A sport simulation system according to claim 2, wherein each component is assigned a unique address.

4. A sport simulation system according to claim 3, wherein each request begins with an address field containing the address of a particular component to which the request is directed.

5. A sport simulation system according to claim 4, wherein the address field is followed by a central field providing information to the addressed component regarding the request.

6. A sport simulation system according to claim 5, wherein the control field instructs the component to perform a certain action.

7. A sport simulation system according to claim 5, wherein the control field is followed by at least one data field which contains instructions to the component and wherein the control field instructs the component how many data fields follow as part of the request.

8. A sport simulation system according to claim 7, wherein the last field in a request is a check sum field adjusted so that the sum of the bits of predetermined portions of predetermined fields of a request equal a predetermined number, and wherein the sum of the bits of predetermined portions of predetermined fields indicates if a request has been properly received.

9. A sport simulation system according to claim 8, wherein the predetermined portion of the fields are the data containing portions thereof.

10. A sport simulation system according to claim 5, wherein the control field includes synchronization information allowing the component to determine if it is synchronized with the control means and the request being received.

11. A sport simulation system according to claim 10, wherein the synchronization information is provided by two data bits of the control field.

12. A sport simulation system according to claim 2, wherein each field contains a start bit, eight data bits, a flag bit, and a stop bit.

13. A sport simulation system according to claim 12, wherein the flag bit distinguishes an address field from other fields.

14. A sport simulation system according to claim 1, wherein all communication in the system is initiated by the sending of a request by the control means.

15. A sport simulation system according to claim 1, wherein the transmission line includes at least two conductors, and wherein digital information is transmitted by changing the voltage status of the two conductors relative to one other.

16. A sport simulation system for simulating the play of a game of golf, comprising a screen toward which a golf ball is hit; projection means for projecting an image on the screen; sensing means for sensing parameters of the flight of a hit golf ball; control means for coordinating operation of the projection means and sensing means and controlling play of the game; communication interface means associated with each of the control means, the sensing means, and projection means; a common transmission line interconnecting the communication interface means associated with each of the control means, the sensing means, and the projecting means; and means within each of the control means, sensing means, and projection means for sending and receiving information via the communication interface means and transmission line, and according to a predetermined format.

* * * * *